428-408 SR
5/29/84 XR 4,451,727

United States Patent [19]
Marinelli et al.

[11] 4,451,727
[45] May 29, 1984

[54] HEATING FIXTURE

[75] Inventors: Donald P. Marinelli, Hamilton Square; Ivan Ladany, Stockton, both of N.J.

[73] Assignee: RCA Corporation, New York, N.Y.

[21] Appl. No.: 326,154

[22] Filed: Nov. 30, 1981

[51] Int. Cl.[3] ..... H05B 3/68
[52] U.S. Cl. ..... 219/464; 174/51; 219/347; 219/461; 219/530; 219/540; 373/118; 428/408
[58] Field of Search ..... 219/345, 355, 347, 405, 219/461, 462, 463, 464, 530, 536, 540, 214, 381, 408, 411, 430, 432, 433, 439; 373/118, 137; 174/51; 428/408

[56] References Cited

U.S. PATENT DOCUMENTS

| | | | |
|---|---|---|---|
| 2,127,239 | 8/1938 | Stoady | 373/118 |
| 2,482,933 | 9/1949 | Queneau | 428/408 X |
| 3,243,313 | 3/1966 | Avis, Jr. | 428/408 X |
| 3,390,226 | 6/1968 | Beyerlein | 174/51 X |
| 3,541,305 | 11/1970 | Kuwayama et al. | 219/464 |
| 3,765,475 | 10/1973 | Hooper | 165/12 |
| 3,904,850 | 9/1975 | Johnson | 174/51 X |
| 4,047,496 | 9/1977 | McNeilly et al. | 118/49.1 |
| 4,107,514 | 8/1978 | Ellson | 174/51 X |
| 4,220,846 | 9/1980 | Rice et al. | 219/381 |
| 4,243,016 | 1/1981 | Kristen et al. | 126/211 |
| 4,251,716 | 2/1981 | Lewis et al. | 219/446 |

*Primary Examiner*—Volodymyr Y. Mayewsky
*Attorney, Agent, or Firm*—Birgit E. Morris; Theodore R. Furman

[57] ABSTRACT

An improved heating fixture, wherein the support means upon which a workpiece to be heated is mounted, is a vitreous carbon plate. The use of a vitreous carbon support plate significantly reduces the time required to heat and cool the support plate and a workpiece thereon.

3 Claims, 1 Drawing Figure

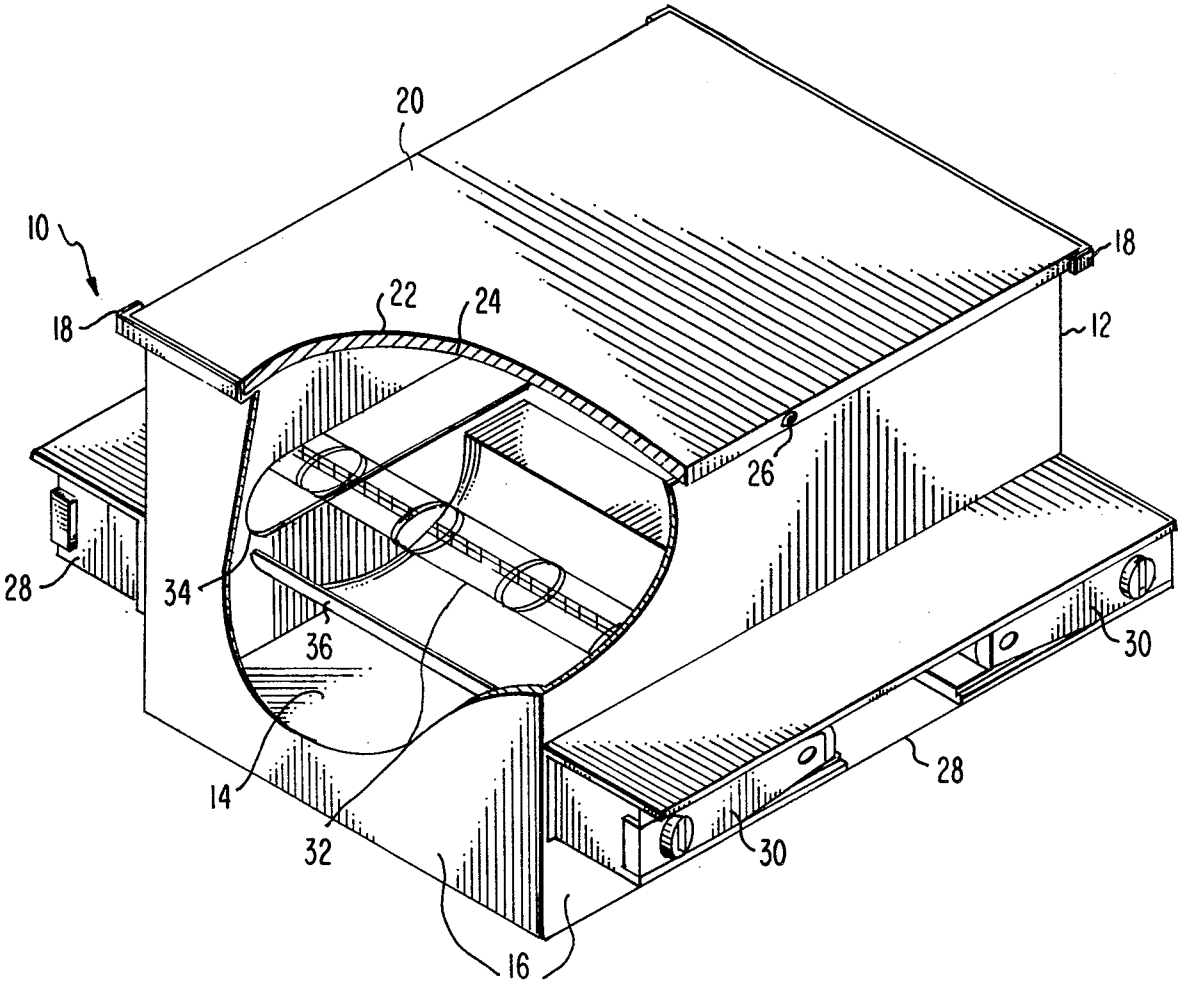
10
18
20
22
24
26
12
18
28
30
30
28
16
32
14
36
34

HEATING FIXTURE

The invention relates to an improved fixture for heating a workpiece and, in particular, to such a fixture having fast heating and cooling times.

BACKGROUND OF THE INVENTION

A fixture for heating a workpiece typically comprises an energy source and a support means on which the workpiece is placed and which is disposed to absorb energy from the source. Together the energy source and the support means may be mounted on a support frame or may consist of separate components. The energy source is typically an electrical resistance heater either in contact with the support plate or is a radiant heater such as a tungsten-halogen lamp. The support means is typically a metal plate having a low thermal mass and a high thermal conductivity. Disadvantages of such a heater are that it is slow in reaching the desired operating temperature, sometimes an hour or more, and that the temperature achieved tends to be very non-uniform across the support plate because it depends on the local surface emissivity of the support plate. In addition, non-uniformities in the surface of the support plate arising from surface irregularities, contamination of the surface and cleaning processes used to remove the contamination prevent good thermal contact from being made between the surface plate and the workpiece. Thus, it would be desirable to have a heating fixture with fast heating and cooling times and an improved thermal contact between the surface of the support plate and the workpiece.

SUMMARY OF THE INVENTION

The invention is an improved heating fixture where the improvement comprises a vitreous carbon plate as the support means. The vitreous carbon plate provides heating and cooling times on the order of minutes as compared to the hour or more heating and cooling times needed with prior art support plates.

BRIEF DESCRIPTION OF THE DRAWING

The FIGURE is a perspective view partially cut away of a heating fixture of the invention.

DETAILED DESCRIPTION

Referring to the FIGURE, the heating fixture 10 includes a support frame 12 which comprises a base 14, sidewalls 16 attached to and extending perpendicularly from the base 14, and a support plate holder 18 attached to the side walls 16. A support plate 20 having exterior and interior major surfaces 22 and 24 respectively is mounted in the support plate holder 18. The support plate 20 has an opening 26 extending a distance into the side of the plate for the insertion of a temperature sensing device. Lamp supports 28 are mounted on a pair of opposite sidewalls 16 and have lamp electrical contacts 30 attached thereto. One or more radiant heating lamps 32 are mounted in the lamp contacts 30 and extend through openings 34 in opposed sidewalls 16 and across the interior of the support frame 12. A reflector 36 is positioned adjacent to each lamp 32 to reflect light onto the interior major surface 24 of the support plate 20.

The support frame 12, including the base 14, the sidewalls 16, the support plate holder 18 and the lamp supports 28 may be fabricated using techniques standard in the art.

The support plate 20 is formed of a plate of vitreous carbon having a thickness sufficient to support a workpiece placed thereon and yet thin enough so that the thermal mass of the support plate is not excessive. We have found that a vitreous carbon plate having a thickness of about 1.8 millimeters (mm) performs surprisingly well. We have also found it useful to grind the exterior major surface 22 of the vitreous carbon plate on which the workpiece is placed to a high degree of flatness to improve the heat transfer from the support plate 20 to the workpiece. The useful degree of flatness depends upon the size of the workpiece and is typically about $\pm 10$ micrometers ($\mu$m). We have used a type V-25 vitreous carbon plate purchased from ATOMERGIC CHEMETALS CORPORATION, Plainview, N.Y. 11803 which has thickness before grinding of about 2 mm.

The radiant heating lamps useful in the heating fixture of the invention are type 500T3Q/CL/SCL 500 watt tungsten-halogen lamps together with lamp electrical contacts manufactured by GTE SYLVANIA, INC. Typically a pair of such lamps are used in the heating fixture of the invention.

A heating fixture was constructed according the principles described above, using a 100 mm square vitreous carbon support plate together with two 500 watt tungsten-halogen lamps. The temperature of the support plate in vacuum, as measured by a thermocouple inserted into an opening in the side of the support plate, increased from 22° C. to 450° C. in about 4 minutes after the tungsten-halogen lamps were turned on. After the power to the lamps was turned off the temperature of the support plate cooled to about 50° C. in 15 minutes. Under the same conditions with a stainless steel support plate the heating time was 1 hour and the cooling time was about 2 hours.

The vitreous carbon support plate is also useful in that it is not easily attacked by acids and is non-porous. It can thus be cleaned easily with strong reagents without damage to the surface upon which the workpiece rests. Thus protective materials usually placed on the support plate are not needed.

Vitreous carbon differs from graphite in that it is a glassy, non-crystalline material while graphite has a hexagonal structure. Graphite is undesirable for use as a support plate since its softness, porosity and lack of resistance to chemical attack make it difficult to clean and can cause changes in its surface emissivity. Vitreous carbon, however, maintains its surprisingly high performance through repeated cycling with or without cleaning.

We claim:

1. In a heating fixture comprising an energy source, support means disposed to absorb energy from said energy source for heating said support means and a workpiece thereon, and an enclosed support frame including mounting means for said energy source and said support means; wherein the improvement comprises a non-porous, ridid, heat conductive, vitreous carbon plate ground to a desired degree of flatness as the support means and being mounted on said support frame for said energy source.

2. The article of claim 1 wherein said energy source is a radiant heater.

3. The article of claim 2 wherein a reflector is mounted on said support frame, such that energy from said energy source emitted away from said support means is reflected back toward said support means.

* * * * *

UNITED STATES PATENT AND TRADEMARK OFFICE
CERTIFICATE OF CORRECTION

PATENT NO. : 4,451,727

DATED : May 29, 1984

INVENTOR(S) : Donald P. Marinelli, Ivan Ladany

It is certified that error appears in the above-identified patent and that said Letters Patent is hereby corrected as shown below:

In the Claims:

Claim 1, column 2, line 58, "ridid" should be --rigid--.

Signed and Sealed this

*Twelfth* Day of *February 1985*

[SEAL]

*Attest:*

DONALD J. QUIGG

*Attesting Officer* *Acting Commissioner of Patents and Trademarks*